United States Patent [19]

Schlitt et al.

[11] Patent Number: 4,495,440

[45] Date of Patent: Jan. 22, 1985

[54] ARC-EXTINGUISHING AMPUL AND FLUORESCENT LAMP HAVING SUCH AMPUL MOUNTED ON EACH ELECTRODE STRUCTURE

[75] Inventors: Steven C. Schlitt, Merrimac; Thomas S. Yong, Danvers; William J. Roche, Merrimac; John W. Anderson, Jr., Ipswich, all of Mass.

[73] Assignee: GTE Products Corporation, Stamford, Conn.

[21] Appl. No.: 410,274

[22] Filed: Aug. 23, 1982

[51] Int. Cl.[3] ..... H01J 61/10; H01J 61/42; H01J 61/28

[52] U.S. Cl. ..... 313/492; 313/546; 313/551

[58] Field of Search ..... 313/546, 492, 550, 551

[56] References Cited

U.S. PATENT DOCUMENTS

| | | | |
|---|---|---|---|
| 2,424,457 | 7/1947 | Haynes et al. | 313/546 |
| 3,215,892 | 11/1965 | Waymouth | 313/546 X |
| 3,265,917 | 8/1966 | Ray | 313/493 |
| 3,562,571 | 2/1971 | Evans et al. | 313/490 |
| 3,898,511 | 8/1975 | Johnson et al. | 313/490 |
| 4,105,910 | 8/1978 | Evans | 313/490 |
| 4,182,971 | 1/1980 | Cassidy et al. | 313/546 |

*Primary Examiner*—Palmer Demeo

*Attorney, Agent, or Firm*—Joseph S. Romanow

[57] ABSTRACT

An arc-extinguishing ampul and a low-pressure arc discharge lamp, such as a fluorescent lamp, having such ampul on each electrode structure, the ampul comprising a thin-walled glass body enclosing an arc-extinguishing gas, at least one electrically conductive support wire, and a heat-conductive coating covering the outer surface of the ampul and portions of the support wire. Upon depletion of the electron-emissive coating on one electrode filament at the end of the useful life of the lamp, the arc discharge is attracted to the ampul by the support wire. The heat of the arc softens and melts the ampul to the point where the arc-extinguishing gas within the ampul escapes and renders the lamp inoperable without loss of the lamp's hermetic seal.

6 Claims, 7 Drawing Figures

ARC-EXTINGUISHING AMPUL AND FLUORESCENT LAMP HAVING SUCH AMPUL MOUNTED ON EACH ELECTRODE STRUCTURE

TECHNICAL FIELD This invention relates to the field of low-pressure arc discharge lamps. More particularly, the invention relates to low-pressure arc discharge lamps, such as fluorescent lamps, having a structure or device which renders the lamp inoperable at the end of its useful life without loss of the lamp's hermetic seal.

BACKGROUND OF THE INVENTION

Low-pressure arc discharge lamps and, in particular, fluorescent lamps are well known; see IES Lighting Handbook, 1981 Reference Volume, Section 8.

Herein, the terms "end-of-life" and "end of the useful life" of a low-pressure arc discharge lamp are defined as that time when the electron-emissive material on one electrode filament has been depleted so that the arc discharge destroys the filament and strikes other parts of the electrode structure.

Low-pressure arc discharge lamps, especially those designed for operation at high current loading, such as very high output (VHO) lamps, sometimes fail by causing the fracture of the glass envelope. It is believed the sequence of events leading to such failures is as follows. At the end of the useful life of the lamp, the electron-emissive material on one of the electrode filaments becomes depleted. When such depletion occurs, the arc discharge strikes other components of the electrode structure and, in particular, the arc strikes the lead-in wires supporting the electrode structure. The lead-in wires are heated by the arc to the point where the wires soften and bend. Subsequently, the lead-in wires and the electrode structure sags and comes in contact with the glass envelope. The severe heat generated by the arc and the heated electrode structure cause the glass envelope to fracture.

Various internal structures for low-pressure arc discharge lamps have been proposed which cause the lamp to fail without fracture of the glass envelope. Such structures are suggested in the following references.

U.S. Pat. No. 3,265,917, issued Aug. 9, 1966, to Ray, discloses a structure comprising a wire or conductive coating electrically connected to the inside portion of the electrode structure and extending to a thin-walled portion of the stem. Upon depletion of the electron-emissive material on the electrode filament, the arc strikes and follows the conductive path reaching the thin-walled portion of the stem. The heat generated by the arc and the heated conductor softens and melts the thin wall of the stem to the point where the hermetic seal is lost. The introduction of the external atmosphere into the lamp extinquishes the arc discharge and renders the lamp inoperable.

Japanese patent publication No. 44-15840, dated July 14, 1969, by Sometani et al., discloses a structure comprising a strip of aluminum powder coating over a portion of the stem and in electrical contact with one of the inside lead-in wires.

U.S. Pat. No. 3,562,571, issued Feb. 9, 1971, to Evans and Morehead, discloses a structure for an amalgam-regulated low-pressure arc discharge lamp which serves the dual function of providing an auxiliary source of amalgam for faster warm-up and providing for extinguishment of the arc discharge at the end of the useful life of the lamp. The end-of-life structure comprises a notched yoke of wire mesh or sheet metal electrically connected to an inside lead-in wire and clipped onto the stem press near an exterior portion of the lead-in wire.

U.S. Pat. No. 4,105,910, issued Aug. 8, 1978, to Evans discloses a structure providing for an auxiliary source of amalgam and for end-of-life extinguishment of the arc. This structure comprises a coating of a suitable amalgamative metal on portions of the stem press and the inside lead-in wire about the point where the lead-in wire emerges from the stem press.

A copending U.S. patent application, Ser. No. 349,722, filed Feb. 18, 1982, by Young and Sadoski, assigned to GTE Products Corporation, discloses a combination getter and end-of-life structure comprising a coating of aluminum and zirconium; such coating being applied to selected areas of the stem, having electrical contact with at least one inside lead-in wire, and extending to a thin-walled portion of the stem's body.

In the aforementioned references, the end-of-life extinguishment of the arc discharge is based on the principle of breaking the lamp's hermetic seal through a thin-walled portion of the stem. An internal structure or device having the ability to extinguish the arc discharge at the end of the useful life of a low-pressure arc discharge lamp without causing the loss of the lamp's hermetic seal is desirable and would be an advancement of the art.

DISCLOSURE OF THE INVENTION

It is, therefore, an object of this invention to obviate the disadvantages of the prior art.

It is another object of this invention to provide a means for extinguishing the arc discharge of a low-pressure arc discharge lamp at the end of the useful life of the lamp without compromising the integrity of the lamp's hermetic seal.

These objects are accomplished, in one aspect of the invention, by the provision of an arc-extinguishing ampul for a low-pressure arc discharge lamp. The ampul comprises a thin-walled glass body enclosing a hermetically sealed cavity. The glass thin-walled ampul body or a portion thereof will rupture when raised to the melting point of the glass. Arc-extinguishing fluid is contained within the cavity. There is at least one electrically conductive support wire mounted to the body of the ampul. A heat-conductive coating covers the outer surface of the ampul body and a portion of the support wire.

These objects are further accomplished, in another aspect of the invention, by the provision of a low-pressure arc discharge lamp having at least two arc-extinguishing ampuls. The lamp comprises a hermetically sealed tubular glass envelope having a luminescent material coated on the interior surface thereof and two opposed ends. There is a glass stem at each end of the envelope. The stem comprises a flare sealed to the envelope and an inwardly projecting body terminating in a press. An electrode structure is mounted on each stem. The electrode structure comprises two lead-in wires sealed in the press and a filament mounted on the lead-in wires. The filament has a coating of electron-emissive material on it. Within the envelope, there is a fill which is an arc discharge generating and sustaining medium.

An arc-extinguishing ampul is mounted on each electrode structure. The ampul body comprises a thin glass wall enclosing a hermetically sealed cavity. The thin glass wall is such that it or a portion thereof will rupture when raised to the melting point of the glass. Within the ampul cavity, there is an arc-extinguishing fluid. At least one electrically conductive support wire is mounted to the ampul body and the electrode structure. The support wire is a means for mounting the ampul to the electrode structure. A heat-conductive coating covers the outer surface of the ampul and a portion of the support wire.

When the electron-emissive material has been depleted from one of the electrode filaments, the arc discharge will strike the corresponding electrode structure and, in particular, the arc will strike and follow the support wire up to and including the ampul. The heat generated by the arc will be conducted to the ampul body by the heat-conductive coating thereby raising the temperature of the ampul body above the critical temperature. Under this intense heat, the thin-walled ampul body softens, melts, and ruptures; whereupon the hermetic seal of the ampul cavity is lost and the arc-extinguishing fluid therein escapes. The escape of the fluid extinguishes the arc discharge and renders the lamp inoperable.

Thus, there are provided a structure or device and a low-pressure arc discharge lamp employing same which will extinguish the arc discharge at the end of the useful life of a the lamp without causing the loss of the lamp's hermetic seal.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
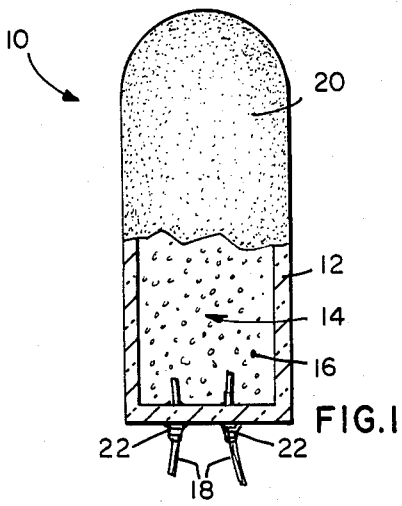
FIG. 1 is an elevational view of one embodiment of an arc-extinguishing ampul with parts broken away for clarity.

Referring now to the drawings with greater particularity, FIG. 1 shows one embodiment of an arc-extinguishing ampul 10. The ampul comprises a thin-walled glass body 12 enclosing a hermetically sealed cavity 14. Ampul body 12 has the property that it or a portion thereof will rupture when heated to the melting point of the glass. Within cavity 14, there is an arc-extinguishing fluid 16 shown as a collection of dots in the broken-away portion of cavity 14 in the drawing. Mounted to body 12 is at least one electrically conductive support wire 18. In the embodiment shown in the drawing, there are two support wires 18 mounted by means of being imbedded in body 12. The two support wires 18 are electrically isolated. Covering the outer surface of body 12 and portions of support wires 18 is a heat-conductive coating 20. As the drawing depicts, the coating covers support wires 18 at least over the junction points 22 where wires 18 emerge from ampul body 12.

Arc-extinguishing fluid 16 must have the property that when released within the envelope of an operating low-pressure arc discharge lamp, fluid 16 will disable the lamp. One embodiment of fluid 16 would be a gas which will react with the internal atmosphere of the lamp such that an arc discharge no longer may be generated and maintained. An electronegative gas having a high electron-attachment cross section has this arc-quenching characteristic. Some examples of this type of gas are sulfur hexafluoride, nitrous oxide, and carbon dioxide.

Figure 2:
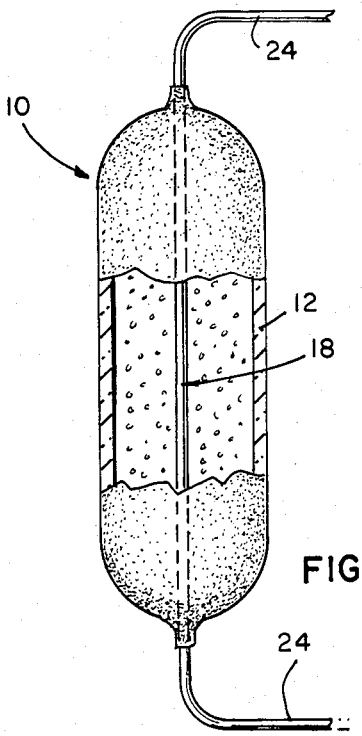
FIG. 2 and FIG. 3 are elevational views of other embodiments of arc-extinguishing ampuls with parts broken away for clarity.

FIG. 2 shows another embodiment of ampul 10 in which a single support wire 18 passes through body 12 approximately along the longitudinal axis of body 12. When this embodiment is used, ends 24 of support wire 18 must be connected to components of the electrode structure having the same electrical potential in order to avoid a short circuit.

Figure 3:
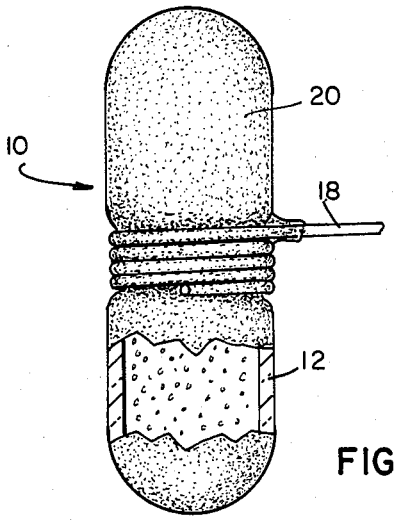

FIG. 3 shows still another embodiment of ampul 10. Body 12 may have a slightly narrower central band, as is depicted in the drawing. Support wire 18 is securely wrapped around body 12 after which heat-conductive coating 20 is applied over body 12 and the wrapped portion of support wire 18.

Figure 4:
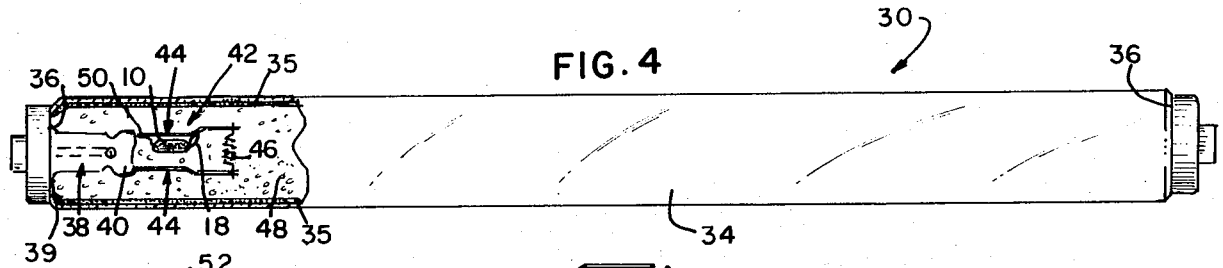
FIG. 4 is an elevational view of a fluorescent lamp employing arc-extinguishing ampuls, with parts broken away to show the interior parts at one end of the lamp.

FIG. 4 shows an embodiment of a low-pressure arc discharge lamp 30, this embodiment being a fluorescent lamp, having an arc-extinguishing ampul 10 at each end thereof. In the drawing, the internal parts of lamp 30 are shown at only one end.

Lamp 30 comprises hermetically sealed tubular glass envelope 34 which has luminescent material 35 coated on the internal surface thereof and two opposed ends 36. Glass stem 38, comprises flare 39 sealed to each end 36 and an inwardly projecting body terminating in a press 40. Electrode structure 42 is mounted on stem 38 by means of two lead-in wires 44 sealed into press 40. Filament 46 is mounted on lead-in wires 44. There is a coating of electron-emissive material, not shown in the drawing, on filament 46. Within envelope 34, there is a fill 48 shown as a collection of dots in the drawing. Fill 48 is a medium in which an arc discharge may be generated and sustained.

Ampul 10 is mounted to electrode structure 42 by means of support wire 18. In this embodiment, ampul 10 is mounted on one lead-in wire 50. Support wire 18 is electrically connected, as by welding, to lead-in wire 50.

Electrode structure 42, as depicted in this embodiment, has only the minimum number of components. Other electrode structures may include a heat shield and probe wires. Electrode structures with a fewer or greater number of components may be used. Ampul 10 may be mounted on any component of the electrode structure between filament 46 and stem 38 as long as an electrical short circuit is avoided.

When the election-emissive material on filament 46 has been depleted, the arc discharge of lamp 30 will strike the electrode structure 42 and, in particular, the arc will strike and follow support wire 18 up to and including ampul 10. The principal function of heat-conductive coating 20 is to draw and concentrate heat from the arc discharge to ampul body 12 so that the melting point of body 12 will be reached or exceeded. Coating 20 may be comprised of a binder and an element from the group consisting of aluminum, zirconium, and indium, or a mixture thereof; such a coating exhibits favorable heat-conduction properties with reasonable economy and ease of application. Coating 20 may be comprised of many other metals since most electrically conductive materials are also heat-conducting. The electrical properties of coating 20 are not a principal concern.

Figure 5:
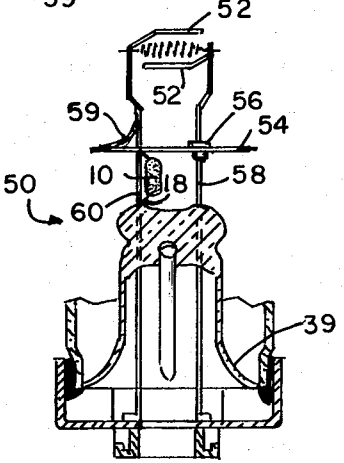
FIG. 5 is an elevational view of an electrode structure of a low-pressure arc discharge lamp showing one possible placement of an arc-extinguishing ampul thereon.

FIG. 5 shows an embodiment of the invention with an alternate electrode structure 50 including probe wires 52, which serve as additional anodes, electrically conductive heat shield 54, and ceramic insulator 56 which isolates lead-in wire 58 from heat shield 54. Heat shield 54 is electrically connected to lead-in wire 60 by means of conductive strap 59, which may be welded to heat shield 54 and lead-in wire 60. Ampul 10 is mounted, mechanically and electrically, to lead-in wire 60 as may be achieved by welding support wire 18 to lead-in wire 60.

Figure 6:
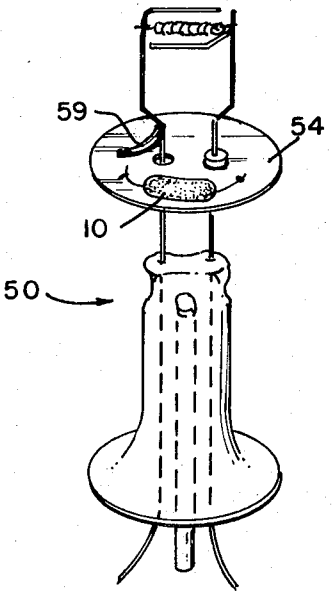

FIG. 6 shows ampul 10 mounted on the side of electrically conductive heat shield 54 facing the filament of electrode structure 50. This is another feasible mount for ampul 10.

Figure 7:
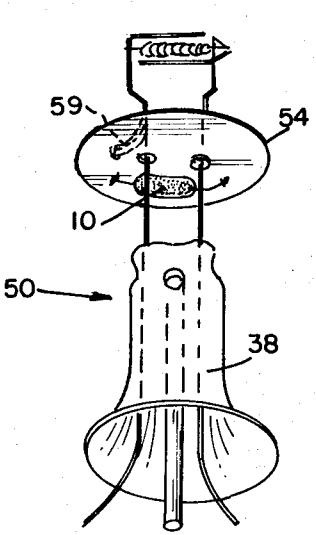
FIG. 6 and FIG. 7 are pictorial views of electrode structures of low-pressure arc discharge lamps showing two other possible placements of arc-extinguishing ampuls.

FIG. 7 shows ampul 10 mounted on the side of electrically conductive heat shield 54 facing stem 38 of electrode structure 50. This is still another feasible mount for ampul 10.

In laboratory examples of the invention, ampul 10 was contructed from soft glass, such as lead glass or soda-lime glass with melting points approximately 630° C. and 700° C. respectively. The ampul body was approximately 0.75 inches long with diameter approximately 0.156 inches. The thickness of ampul walls was approximately 0.023 inches. Support wire 18 was nickel wire having a diameter 0.04 inches. Coating 20 comprised aluminum and zirconium. Fluid 16 was sulfur hexafluoride or nitrous oxide with fill pressure being approximately one atmosphere.

While there have been shown and described what are at present considered to be the preferred embodiments of the invention, it will be apparent to those skilled in the art that various changes and modifications can be made herein without departing from the scope of the invention as defined by the appended claims.

We claim:

1. A low-pressure arc discharge lamp comprising:

(a) a hermetically sealed tubular glass envelope having a luminescent material coated on the interior surface thereof and two opposed ends;

(b) a glass stem at each of said ends, said stem comprising a flare sealed to said envelope and an inwardly projecting body terminating in a press;

(c) an electrode structure mounted on each stem, said electrode structure comprising two lead-in wires sealed in said press and a filament mounted on said lead-in wires, said filament having a coating of electron-emissive material thereon;

(d) two heat shields, one of said heat shields being mounted on each electrode structure between said filament and said glass stem;

(e) a fill within said envelope, said fill being an arc discharge generating and sustaining medium;

(f) two arc-extinguishing ampuls, one of said ampuls being mounted on each heat shield on the side facing said filament, each ampul having a thin glass wall enclosing a hermetically sealed cavity and being such that said body or a portion thereof will rupture when raised to the melting point of the glass;

(g) an arc-extinguishing fluid within said cavity;

(h) at least one electrically conductive support wire mounted to said ampul, said support wire being means for mounting said ampul on said heat shield; and (i) a heat-conductive coating covering the outer surface of said ampul and a portion of said support wire.

2. The low-pressure arc discharge lamp of claim 1 wherein said arc-extinguishing fluid comprises an arc-extinguishing gas at suitable pressure, said arc-extinguishing gas being an electronegative gas having a high electron-attachment cross section.

3. The low-pressure arc discharge lamp of claim 2 wherein said arc-extinguishing gas is selected from the group consisting of sulfur hexafluoride, nitrous oxide, and carbon dioxide.

4. The low-pressure arc discharge lamp of claim 3 wherein said heat-conductive coating comprising a binder and an element selected from the group consisting of aluminum, zirconium, and indium, or a mixture thereof.

5. The low-pressure arc discharge lamp of claim 4 wherein said support wire is nickel and has a diameter of approximately 0.04 inches.

6. The low-poressure arc discharge lamp of claim 5 wherein said lamp is a fluorescent lamp.

* * * * *